United States Patent [19]

MacDonald et al.

[11] Patent Number: 4,688,720

[45] Date of Patent: Aug. 25, 1987

[54] NOZZLE FOR AN ARCHITECTURAL FOUNTAIN

[75] Inventors: Richard L. MacDonald, Glendora; Ernst von Winckelmann, South Pasadena, both of Calif.

[73] Assignee: Kidde Consumer Durables Corporation, City of Industry, Calif.

[21] Appl. No.: 853,776

[22] Filed: Apr. 18, 1986

[51] Int. Cl.[4] ..... B05B 17/08; B05B 1/04

[52] U.S. Cl. ..... 239/17; 239/463; 239/592; 239/597; 239/601; D23/34

[58] Field of Search ..... 239/16–19, 239/463, 589, 590, 592, 595, 597, 601; D23/13, 34, 35

[56] References Cited

U.S. PATENT DOCUMENTS

| | | | |
|---|---|---|---|
| D. 35,335 | 11/1901 | Luff | D23/34 X |
| D. 96,152 | 7/1935 | Zinkil | D23/35 |
| D. 266,451 | 10/1982 | Berry, Jr. | D23/13 |
| 487,628 | 12/1892 | Lockhart | 239/597 X |
| 3,292,861 | 12/1966 | Kawamura et al. | 239/597 X |

FOREIGN PATENT DOCUMENTS

| | | | |
|---|---|---|---|
| 959978 | 6/1964 | United Kingdom | 239/601 |
| 518236 | 7/1976 | U.S.S.R. | 239/597 |

*Primary Examiner*—Andres Kashnikow
*Assistant Examiner*—Mary Beth Jones
*Attorney, Agent, or Firm*—Donald D. Mon

[57] ABSTRACT

A nozzle for an architectural fountain which has fixed deflector surfaces that produce a plume divided into well-aerated drops of substantial size.

3 Claims, 3 Drawing Figures

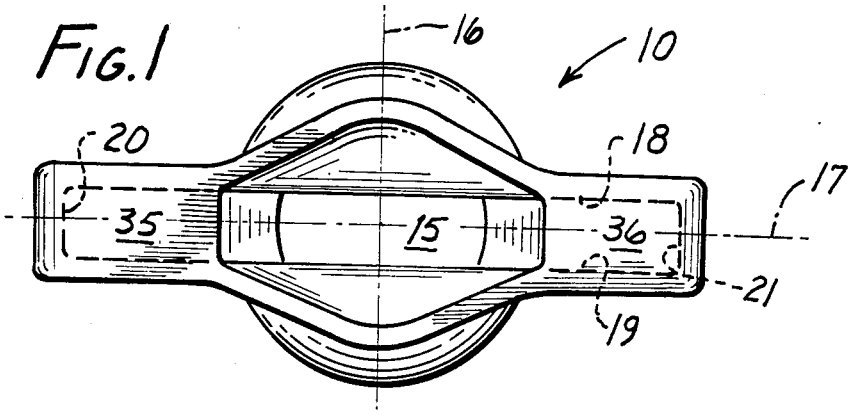
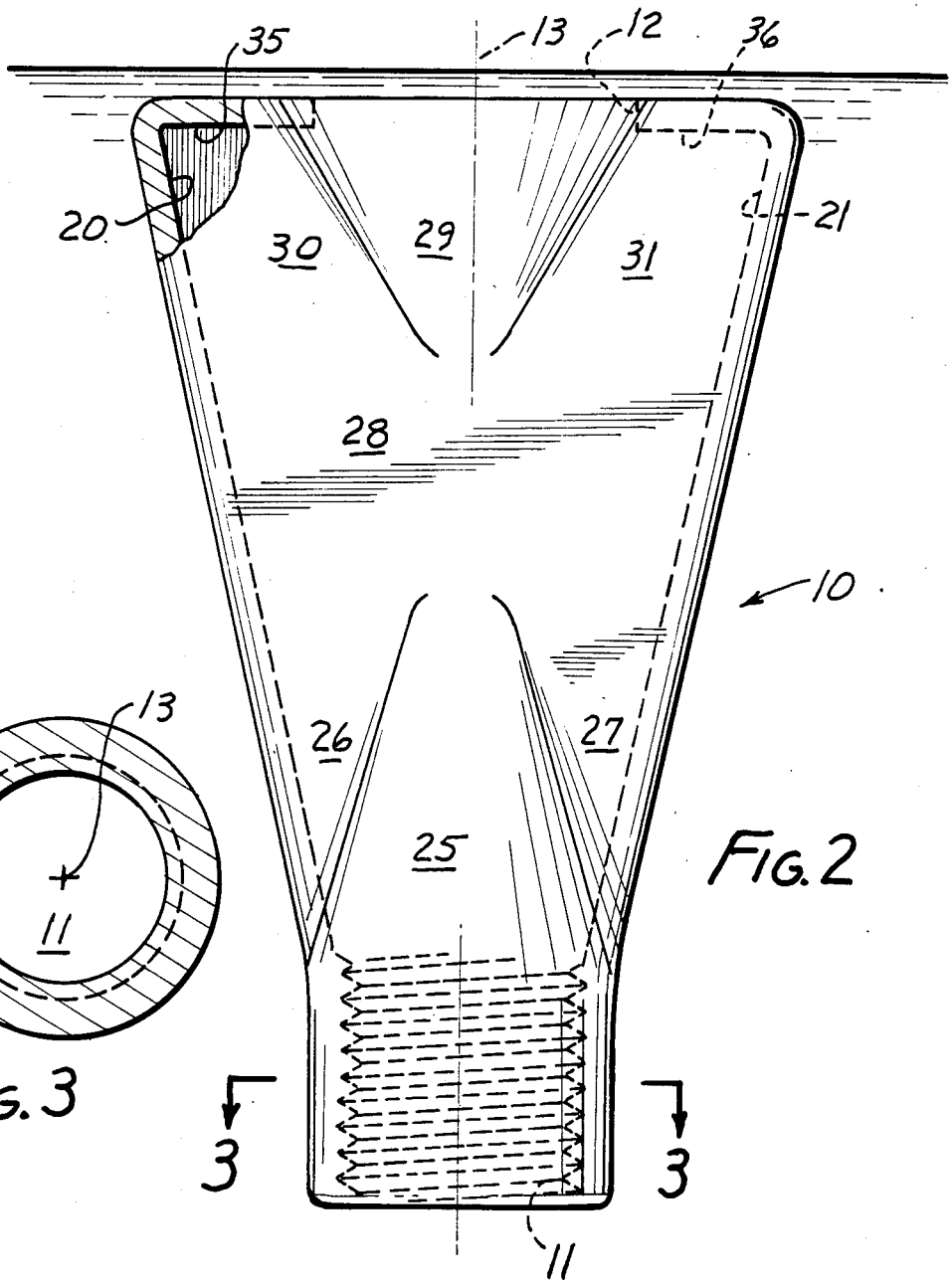
FIG. 2
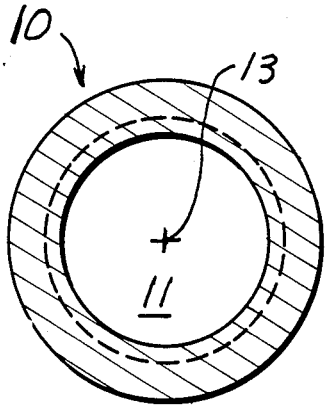
FIG. 3

NOZZLE FOR AN ARCHITECTURAL FOUNTAIN

FIELD OF THE INVENTION

This invention relates to nozzles for architectural fountains, and especially to a nozzle without moving parts which produces a water plume that is attractive both in natural light and when artificially illuminated.

BACKGROUND OF THE INVENTION

Architectural fountains are generally used for relatively large-scale decoration, such as in open plazas, lobbies, and the like. Their shape is selected to accomplish the architect's artistic objectives, and when in operation are intended to provide a sense of shape and texture. The shape is attained by using nozzles, deflectors, and the like, and the texture is determined by the cohesiveness of the stream, by its content of air bubbles, and by the size of its drops or droplets.

When the droplets are very fine, then the pattern emerges more as a spray which is perceived as a body that can merge on the opaque. It is at the best translucent, and does not sparkle. While this effect may be and sometimes is appropriate for some fountain installations, there is a considerable preference for plumes which have a sparkling clarity, and a sense of body, and which when illuminated give a sparkling, even twinkling display of considerable beauty.

A determinant of the plume which determines whether the display will be a spray, a clear stream, or a sparkling plume is the size of the drops. A spray by definition has very small droplets, and presents a diffuse appearance. At the opposite extreme, a clear cohesive stream has no appreciable droplets, and it appears almost as a rod. It takes illumination poorly.

Another significant determinant in fountain displays is the aeration of the stream. A non-aerated stream has a clear appearance, and does not appear to have much body. While it illuminates acceptably in sunlight, it illuminates poorly at night. A properly aerated stream illuminates well in both sunlight and in artificial lighting, and when the streams are comprised of large droplets that are aerated, an optimally visible fountain display results.

Accordingly, it is an object of this inventon to provide a nozzle whose output includes large numbers of drops of major size, and with substantial aeration of these drops.

It has been found that drops of major size are most advantageously formed by violent agitation of the water stream. While water is readily agitated by spinners, choppers, and the like, it is a useful objective to attain a pattern from an agitated stream with the use of a nozzle which has no moving parts. Such a nozzle is then maintenance free, and is less expensive to manufacture.

It is another object of this invention to provide a nozzle whose output is aerated to improve the display.

BRIEF DESCRIPTION OF THE INVENTION

A nozzle according to this invention has a central axis of flow. The nozzle is symmetrical about two rectilinearly related axial planes. It has a body with a central cavity having a major dimension along a first of said planes. A water inlet port communicates with the cavity, and discharges a stream of water axially into the cavity. An outlet port is disposed in a plane normal to the central axis, and is centered on the axis.

The cavity is defined by two pairs of opposite, spaced apart walls, the members of each pair being mirror images of one another. These walls extend from said inlet port to said outlet port.

A first pair of said walls is generally fan-like, and is generally aligned with said second plane. An initial portion of each of the walls centrally narrows and tapers inwardly toward the central axis as it extends away from the inlet port, narrowing as it does so, with a flat boundary on each side thereof. A central portion is substantially planar. An exit portion widens and tapers away from said central portion, and is bounded on each side by a flat boundary.

The other pair of spaced apart walls joins the first pair at their edges. They taper away from said central axis as they extend away from the inlet port, thereby providing the apperance of a flat wedge modified by the narrowing and widening portions.

The cavity is partially closed at its outlet end by a pair of flat terminal walls which extend between the outlet port and the second pair of walls, providing a flat termination of the cavity at both sides of the outlet port between the members of the first pair of walls and respective ones of the second set of walls.

The change of flow direction in the cavity produces a turbulent stream which exits from the outlet port in a gross shape that is principally determined by the shape of the outlet port. When it is elongated along the longer second axis, for example, the plume is a rather flat "Peacock tail" shape. Were the dimensions of the outlet port along the two planes more nearly equal, then the pattern would tend toward squarishness or roundness. In any event, the abrupt change of flow direction at the terminal walls, which forces the water to return toward the axis with considerable velocity, causes a turbulence in the exit stream which produces drops of substantial size, of considerable beauty, and illuminability, and without moving parts. In addition, when the outlet port is submerged, water entrained from the surface by the effluent stream not only brings substantial air into the plume, but also fills out the body of the plume near its bottom.

This invention will be fully understood from the following detailed description and the accompanying drawings, in which:

BRIEF DESCRIPTION OF THE DRAWINGS

FIG. 1 is a top view of the presently - preferred embodiment of the invention;

FIG. 2 is a side view partly in cutaway, and partly in schematic notation; and FIG. 3 is a cross-section taken at line 3—3 in FIG. 2.

DETAILED DESCRIPTION OF THE INVENTION

The presently-preferred embodiment of a nozzle 10 according to the invention is shown in the drawings. It is a continuous body with an inlet port 11 and an outlet port 12. It has a central axis 13, the gross flow being axial from inlet port to outlet port. Within that gross flow, there are meaningful changes in the directions of localized flow which will produce a desirable output of turbulent water with substantially sized drops, forming a plume above the outlet port when the central axis is disposed vertically.

Inlet port 11 is circular (FIG. 3), and is internally threaded for attachment to a pipe or a header. It enters into a cavity 15 inside the nozzle, from which the outlet port is the escape. Both ports are centered on the axis.

The cavity is symmetrical about two axial planes 16, 17 that are normal to each other. The intersection of these axial planes with the sheet of the drawings is shown in FIG. 1. First plane 16 has a shorter major axis than second plane 17.

The cavity is defined by two pairs of opposite spaced apart walls. The first pair comprises walls 18 and 19, which are on opposite sides of, and face, second plane 17. The second pair comprises walls 20 and 21 which are on opposite sides of and face first plane 16. The shapes of these walls, together with the shape of the outlet port, are determinants of the turbulence and shape of the exit plume of water.

Walls 18 and 19 are mirror images of one another, and are equally spaced from the central axis, so only wall 19 will be described in detail. It has an initial central portion 25 which centrally narrows and tapers inwardly toward the central axis as it extends away from the inlet port, narrowing as it does so. A flat boundary 26, 27 is formed on each side thereof.

A central portion 28 is substantially planar, and is a continuation of boundaries 26 and 27. An exit portion 29 centrally widens and tapers away from said central portion in the exit direction. It is bounded on each side by a flat boundary 30, and 31.

The other pair of spaced apart walls 20, 21 joins the side walls 18 and 19 at their edges. Walls 20 and 21 are mirror images of one another. They are equally spaced from the central axis. They diverge away from the central axis as they extend away from the inlet port. This provides the general appearance of a flat wedge, modified by the central portions. Walls 20 and 21 are conveniently planar, although they can be a "bent plane", instead of a flat plane.

The cavity is terminated at its outlet end by a pair of flat terminal walls, 35, 36. They extend between the outlet port and walls 20, 21. They are preferably normal to the central axis and provide a flat termination of the cavity at both sides of the outlet port between walls 18 and 19. The outlet port itself has straight boundaries, and in wall 18 and 19 bells out to enlarge at the center. The outlet port is thus a modified rectangle, longer in one dimension than the other, and belled outwardly in the longer dimension.

It will be noted that this central portion expands along plane 16, reversely from central portion 25. Its initial "throat" is narrowed, and as it expands it passes along the regions within portions 30 and 31.

In the internal flow pattern, the water stream from the inlet port has flattened and fanned out. Then, as it enters portion 29, it receives water which has been abruptly stopped by walls 35 and 36, and is given turbulence and lateral change of direction, which violently upset any semblance of coherent axial flow.

The effluent water, while maintaining a desired "gross" pattern violently separates into drops of substantial size (not into a fine spray). The effect is one of a flattish plume of large aerated drops, which when illuminated has jewel-like sparkles. This is a very beautiful display, and is derived from a nozzle with no moving parts.

Should a more squarish or rounded display be desired, the spacing apart of walls 18 and 19 can be increased, and the outlet port shape changed to suit.

Nozzle dimensions can be nicely scaled from the drawings. The nozzle can be made virtually any size. The larger the size, the more gallonage required to drive it.

This nozzle produces an optimally aerated plume when the output port is located beneath the surface of the water in the fountain. Submersions between about $\frac{1}{4}$ inch to about one inch are advantageous, and brief experimentation for the installation will determine the optimum depth of nozzle to produce the best display.

This invention is not to be limited by the embodiment shown in the drawings and described in the description, which is given by way of example and not of limitation, but only in accordance with the scope of the appended claims.

I claim:

1. A one-piece nozzle for an architectural fountain, comprising;

a body having an internal cavity with a central axis, an inlet port entering said cavity, an outlet port exiting said cavity, both being axially aligned on said axis, said cavity being bounded by a first pair and a second pair of walls, the walls of each pair facing one another across said axis and being mirror images of each other, said walls being generally aligned with respective planes that are normal to one another;

said first pair of walls each having an initial portion at the inlet port which centrally narrows and tapers inwardly toward said central axis as it extends away from said inlet port, with a flat boundary at each side thereof, a substantially planar central portion, and an exit portion on the opposite side of the central portion from the initial portion, said exit portion at its center widening and tapering away from said central portion and said central axis;

said second pair of walls joining the members of the first pair to enclose the cavity, diverging away from the central axis as they extend away from said inlet port; and a pair of flat terminal walls substantially normal to said central axis, each extending from a respective one of the walls of said second pair, and joining to both of the walls of said first pair, and having edges which, with the edge of the exit portion form said outlet port.

2. A nozzle according to claim 1 in which said exit portion is longer in alignment with said first planes than with said second planes.

3. A nozzle according to claim 1 in which said edges of said terminal wall are straight.

* * * * *